United States Patent [19]

Agosti et al.

[11] Patent Number: 5,051,715

[45] Date of Patent: Sep. 24, 1991

[54] COUPLING-OUT WINDOW FOR LINEARLY POLARIZED MICROWAVES

[75] Inventors: Giorgio Agosti, Wettingen; Bernd Jödicke, Unterehrendingen; Hans-Günter Mathews, Oberehrendingen; Oskar Schafheitle, Oetwil, all of Switzerland

[73] Assignee: Asea Brown Boveri Ltd., Baden, Switzerland

[21] Appl. No.: 538,669

[22] Filed: Jun. 15, 1990

[30] Foreign Application Priority Data

Jun. 21, 1989 [CH] Switzerland ..... 2314/89

[51] Int. Cl.[5] ..... H01P 1/08

[52] U.S. Cl. ..... 333/252; 333/230

[58] Field of Search ..... 333/228, 230, 252

[56] References Cited

U.S. PATENT DOCUMENTS

| | | | |
|---|---|---|---|
| 2,990,526 | 6/1961 | Shelton, Jr. | 333/252 |
| 3,439,296 | 4/1969 | Buckley | 333/252 |
| 4,965,541 | 10/1990 | Okazaki | 333/252 |

FOREIGN PATENT DOCUMENTS 664045 1/1988 Switzerland .

OTHER PUBLICATIONS

Brown Boveri Review, Jun. 1987, pp. 303-307, H. G. Mathews, et al., "DAS Gyrotron, Schlusselkomponente fur Hochleistungs-Mikrowellensender" (The Gyrotron, Key Component for High-Power Microwave Emitters).

ITG Technical Report on Vacuum Electronics and Displays of the ITG Technical Conference, May 8 to 10, 1989, pp. 203-207, R. Bachmor, "Development of the Technological Principles of a High-Stress Coupling-Out Window for a 200 kW Long-Pulse Gyrotron . . . ".

*Primary Examiner*—Paul Gensler

*Attorney, Agent, or Firm*—Oblon, Spivak, McClelland, Maier & Neustadt

[57] ABSTRACT

A coupling-out window for linearly polarized high-power microwaves exhibits at least one plate transparent to microwaves and cooling fins. The cooling fins are situated together with the plate in a plate plane and are aligned perpendicular to a direction of polarization of the microwaves. They are in heat-conducting and pressure-locking contact with the plate.

9 Claims, 2 Drawing Sheets

COUPLING-OUT WINDOW FOR LINEARLY POLARIZED MICROWAVES

BACKGROUND OF THE INVENTION

1. Field of the Invention

The invention relates to a coupling-out window for linearly polarized high-power microwaves, having at least one plate which is situated in a plate plane and is transparent to microwaves.

2. Discussion of Background

A quasi-optical gyrotron as described, for example, in the Swiss Patent CH-664,045 or in the article "Das Gyrotron, Schlüsselkomponente for Hochleistungs-Mikrowellensender" [The Gyrotron, Key Component for High-Power Microwave Emitters], H. G. Mathews, Minh Quang Tran, Brown Boveri Review 6–1987, pp. 303–307, is in particular suitable for the generation of microwaves of very high power. In such a gyrotron, an alternating electromagnetic field is excited in a quasi-optical resonator, which is accommodated in an evacuated tube, in that the electrons of a beam are forced to gyrate by a strong magnetic field.

The microwaves coupled out from the resonator must be brought through a suitable microwave window out of the high vacuum of the tube into a waveguide under atmospheric conditions and thus to a load. Especially in the case of high-power gyrotrons, the coupling-out window is exposed to very great thermal and mechanical stresses. Not only must it seal off the tube in a vacuum-tight manner, but rather it must also dissipate the unavoidably absorbed power without being damaged.

In the case of continuous wave powers of 1 MW and above, and operating frequencies of typically 100–200 GHz, however, even in the case of the $Al_2O_3$ ceramics known to be particularly suitable for dielectric windows the losses per surface would be so great that such windows would have to burst.

In principle, there are two possibilities for solving the problem of the thermal stressing of microwave windows. The first possibility consists in enlarging the window surface so that the surface stress becomes acceptable. In practice, this solution founders on account of the lack of mechanical stability of such large ceramic windows.

The second possibility, which can also be realized in practice, resides in an appropriate cooling of the plate. A double-plate window which can be cooled is known, for example, from the report "Development of the technological principles of a high-stress coupling-out window for a 200 kW long-pulse gyrotron at 140 GHz", Rudolf Bachmor, ITG Technical Report on Vacuum Electronics and Displays of the ITG Technical Conference from 8 to 10 May 1989. A coolant flows through between two round $Al_2O_3$ ceramic plates, whereby a surface-configuration cooling is achieved.

However, even the known double-plate window does not meet the requirements which a dielectric window in the target power range of 1 MW and above must fulfil. Indeed, the transparency could be intensively improved, if the ceramics were cooled to very low temperatures (e.g. with liquid helium). However, this would involve a disproportionate additional expenditure in terms of economics.

SUMMARY OF THE INVENTION

Accordingly, one object of this invention is to provide a novel window of the initially mentioned type, which window, both in thermal and also in mechanical terms, has been designed to meet the most stringent requirements and avoids the problems which are present in the prior art.

According to the invention, the manner of achieving the object consists in that the coupling-out window of the mentioned type exhibits cooling fins which are disposed in the plate plane perpendicular to a direction of polarization of the microwaves and are in heat-conducting and pressure-locking contact with the at least one plate.

The invention makes use of the fact that on the one hand the modes excited in the resonator of a quasi-optical gyrotron are in principle linearly polarized and that on the other hand predominantly linearly polarized waves are required in the application of microwaves of very high power (heating of plasmas etc). Thus, the restriction to linearly polarized waves does not represent any disadvantage. Rather, it provides the necessary freedom to be able to improve the cooling and the stability at the same time.

Preferably, the cooling fins are designed so that they have a width which is smaller than or equal to an order of magnitude predetermined by a wavelength of the microwaves, and a mutual spacing which is greater than or equal to an order of magnitude corresponding to a wavelength of the microwaves. The cooling fins are, in particular, channels through which coolant flows.

The invention may be advantageously embodied in different ways. Thus, the cooling fins can be either entirely embedded in the plate as cooling channels, or accommodated in groove-like recesses of the plate. In particular, they can be of approximately the same thickness as the plate, so that the latter is divided up into strip-like portions.

Preferably, the cooling fins are at least partially metallic and the plate is made of a ceramic. In this case, the heat-conducting contact is created by a soldered joint. The cooling fins are formed, for example, by quadrilateral, round or oval metal tubes.

In addition, the plate can exhibit, between adjacent cooling fins, cavities filled with coolant.

A quasi-optical gyrotron which is equipped with tube windows according to the invention is capable of emitting radiative powers in the order of magnitude of up to several MW continuous waves.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
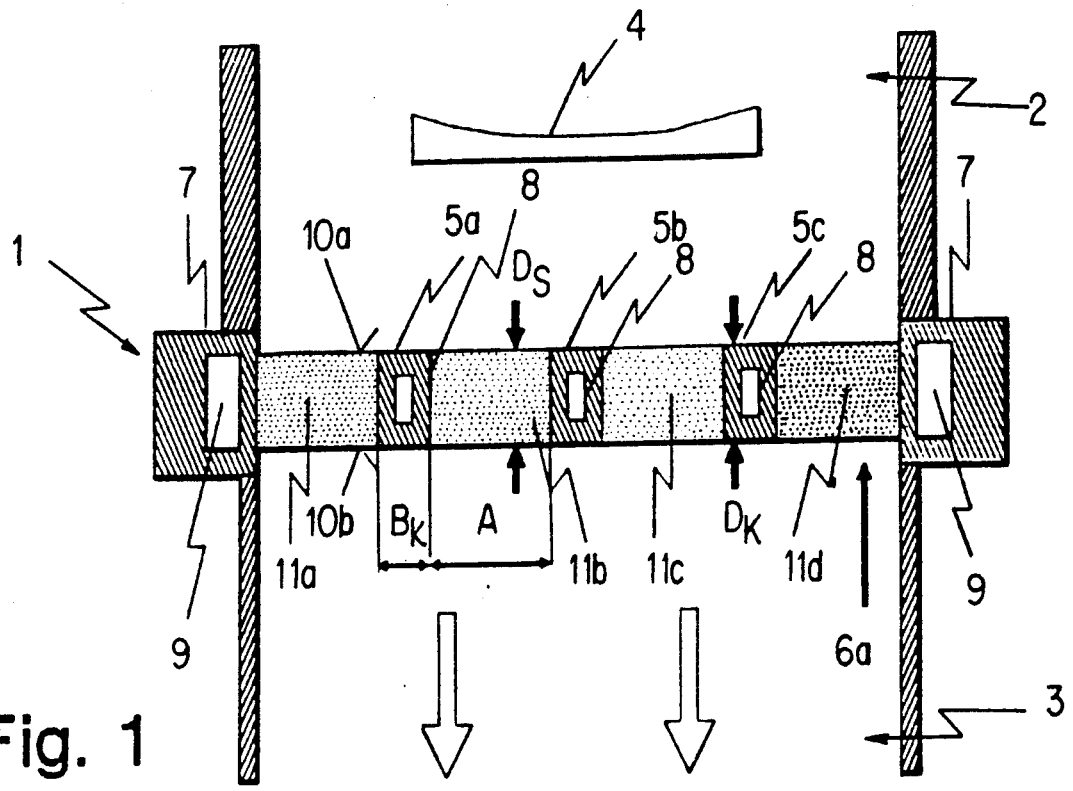
FIG. 1 shows a cross-section of a window with rectangular cooling fins.

The reference symbols used in the drawings and their meaning are tabulated in summary form in the list of designations.

DESCRIPTION OF THE PREFERRED EMBODIMENTS

Referring now to the drawings, wherein like reference numerals designate identical or corresponding parts throughout the several views, in FIG. 1 a coupling-out window 1 is shown such as is incorporated preferably in a quasi-optical gyrotron. The coupling-out window 1 seals off a highly evacuated space 2 of the quasi-optical gyrotron against a wave guide 3, in which atmospheric conditions prevail.

An alternating electromagnetic field oscillates in a resonator of the gyrotron, which resonator is formed by two mirrors, one of which - designated by 4 - is shown in FIG. 1. The alternating electromagnetic field and accordingly the microwaves coupled out from the resonator through the coupling-out window 1 are linearly polarized. The microwaves (indicated by two arrows) are conducted from the wave guide 3 to a load (not shown).

The coupling-out window 1 comprises, for example, three cooling fins 5*a*, 5*b*, 5*c*, a plate 6*a*, which is transparent to microwaves, with strip-like portions 11*a*, 11*b*, 11*c*, 11*d*, as well as an annular mounting 7.

The cooling fins 5*a*, 5*b*, 5*c* are situated together with the plate 6*a* in a common plate plane and are, according to a preferred embodiment, of the same thickness as the plate, $D_k = D_s$, so that two plane main surfaces 10*a*, 10*b* of the plate are formed. In the present illustrative embodiment, the cooling fins are metal tubes of rectangular cross section. Moreover, a coolant 8 flows through them. Preferably, the mounting 7 likewise exhibits one or more channels 9, in order to cool the plate at the periphery as well. The coolant 8, preferably water, is pumped from outside via a suitable connection (not shown in FIG. 1) through the cooling fins 5*a*, 5*b*, 5*c* and the channels 9.

Figure 2:
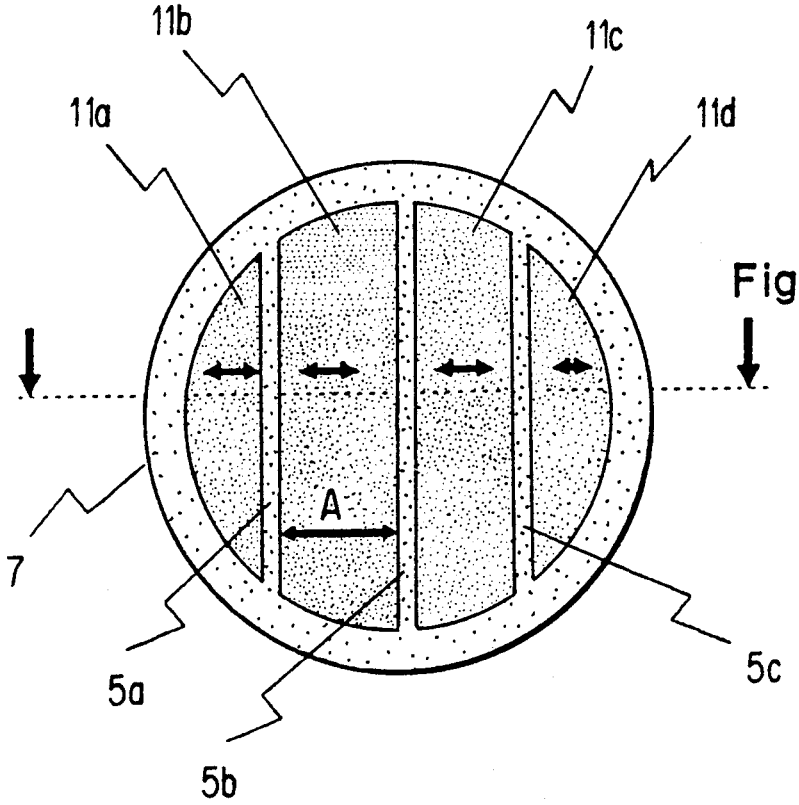
FIG. 2 shows a plan view of a window with three cooling fins.

FIG. 2 shows a front view of the coupling-out window 1. In this representation, the microwaves travel towards the observer and are linearly polarized in the horizontal direction (see double arrows). In FIGS. 1 and 2, identical parts are provided with identical reference symbols.

The cooling fins 5*a*, 5*b*, 5*c* are disposed parallel to one another and perpendicular to the direction of polarization of the microwaves. Their mutual spacing A is preferably several times greater than their width $B_k$. A relevant reference quantity is represented, in this case, by the wavelength of the generated microwaves. Accordingly, the width $B_k$ should be smaller and the mutual spacing A larger than approximately one wavelength.

For a wavelength of, for example, 5 mm, the spacing A can be approximately 10 mm. In these circumstances, the width $B_k$ of the cooling fins is between approximately 1–5 mm.

In principle, in the course of the measurement the effective thermal stress and the mechanical stability of the plate as well as the wave-optics requirements as to spacing A and width $B_k$ of the cooling fins are to be coordinated with one another. Accordingly, the spacing at a circular coupling-out window is not the same between all cooling fins. Where the surface stress is large, the spacing is in certain circumstances advantageously selected to be somewhat smaller than where the surface loss is small. The number of parallel cooling fins, is, of course, also dependent upon the diameter of the plate.

A good, laminar thermal contact prevails between plate 6*a*, which preferably consists of monocrystalline sapphire, and cooling fins 5*a*, 5*b*, 5*c*. The same applies to the mounting 7, which holds the strip-like portions and the cooling fins. The thermal contact is advantageously created by a soldered joint.

Further embodiments of the invention are explained hereinbelow. In the figures, corresponding parts are used with corresponding reference symbols.

Figure 3:
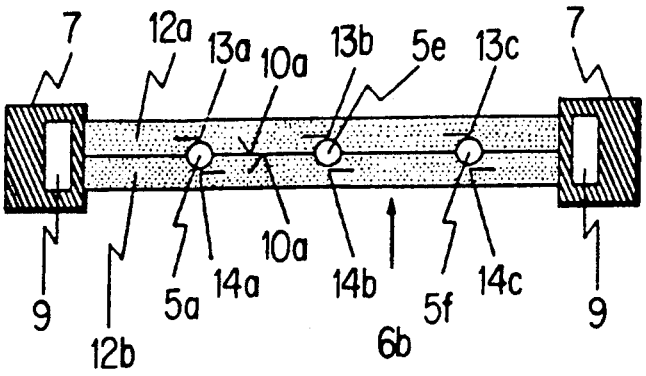
FIG. 3 shows a cross-section of a window with completely embedded cooling fins.

FIG. 3 shows a second illustrative embodiment of the invention. In this embodiment, the cooling fins 5*d*, 5*e*, 5*f* are entirely embedded in a plate 6*b*. One possibility of how this can be realized is described hereinbelow.

The plate 6*b* consists of two circular partial plates 12*a*, 12*b*, which are attached to one another by corresponding main surfaces 10*a*, 10*b*. At these main surfaces 10*a*, 10*b*, the partial plates 12*a*, 12*b* exhibit mutually corresponding, e.g. semicircular recesses 13*a*, 13*b*, 13*c* or 14*a*, 14*b*, 14*c* respectively, which extend parallel to one another and in each instance on a straight line. The recesses are metallized. They receive pairwise 13*a* and 14*a* or 13*b* and 14*b* respectively or 13*c* and 14*c* respectively a respective appropriate, e.g. round metal tube, which is employed as a cooling fin.

Figure 4:
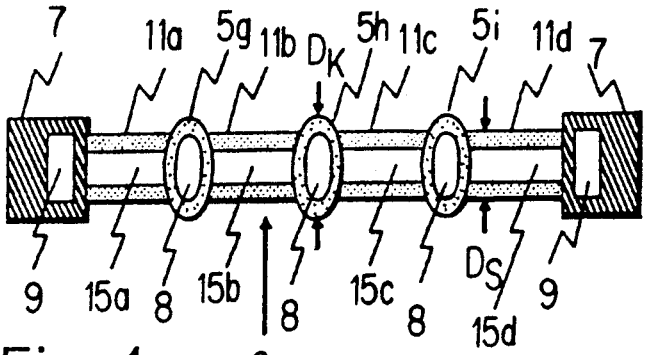
FIG. 4 shows a cross-section of a window with elliptical cooling fins and with cavities between the cooling fins.

FIG. 4 shows a coupling-out window in which a plate 6*c* is additionally provided with cavities 15*a*, 15*b*, 15*c*, 15*d*. A coolant, e.g. FC 43 or FC 75, circulates in these cavities 15*a*, 15*b*, 15*c*, 15*d*, so that the plate is now cooled from three sides, namely both from the two narrow sides and also from an internal main surface.

FIG. 4 also shows a further embodiment for the cooling fins 5*g*, 5*h*, 5*i*. In contrast to the above described examples, the cooling fins 5*g*, 5*h*, 5*i* in this case have a thickness $D_k$ which is greater than the thickness $D_s$ of the plate 6*c*. Thus, they project somewhat on both sides beyond the plate surfaces. In cross-section, the cooling fins are shaped in the manner of an ellipse. A minor semi-axis of this ellipse runs parallel to the plate plane.

The advantage of such elliptical cooling channels resides in that they have, with relatively small width, a large cross-section and thus an advantageously large cooling capacity.

In the illustrative embodiment according to FIG. 4, the plate is thus composed of two partial plates with again, in each instance, a plurality of strip-like portions 11*a*, 11*b*, 11*c*, 11*d*.

Figure 5:
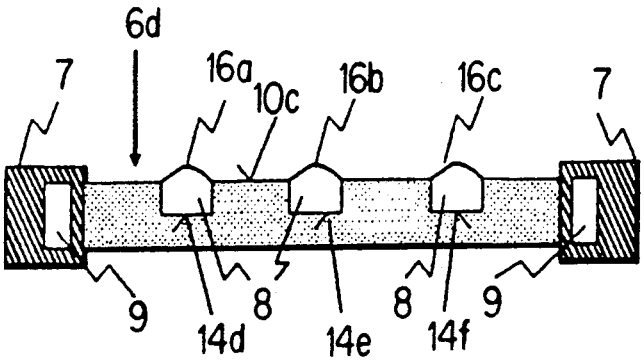
FIG. 5 shows a cross-section of a window, in which the cooling fins are accommodated in groove-like recesses of the plate.

FIG. 5 shows a fourth illustrative embodiment. In this embodiment, a plate 6*d* in one piece is used. One main surface 10*c* of the plate 6*d* is provided with a plurality of recesses 14*d*, 14*e*, 14*f* which extend parallel to one another and in each instance on a straight line. Each recess 14*d*, 14*e*, 14*f* is sealed off by a metal covering 16*a*, 16*b*, 16*c*. In this manner cooling channels are formed, through which a coolant can be pumped.

The metal coverings 16*a*, 16*b*, 16*c* can be flat or outwardly curved. The curved construction does, of course, provide an advantageously larger cross-section than the flat one.

Such cooling fins do not actually guarantee the same mechanical strength as those according to the first or third embodiment. However, their production is simpler.

A greater stability can be achieved if not only a metal covering is applied but in each instance a suitable metal tube is soldered into the recess.

Instead of providing on one main surface recesses with a relatively great depth, it is, of course, also possible to dispose, on both main surfaces, pairwise mutually opposite recesses of small depth. In the direction of passage (perpendicular to the plate plane) in each instance two cooling fins are then situated precisely one behind the other. The weakening of the stability on account of the thickness of the plate being locally reduced at the recesses is at least compensated by the supporting action of the cooling channels.

A large number of advantageous embodiments can be derived, without further ado, from the illustrative embodiments which have been described in detail. In particular, the various cross-sectional shapes (rectangular, circular and elliptical) of the cooling fins can be combined to a large extent arbitrarily with the nature of their manner of accommodation (entirely embedded, fitted on one side or continuously) in the plate.

Metal tubes having good thermal conductivity are preferably used as cooling fins. Besides the particularly preferred monocrystalline sapphire, high-stress ceramics are also suitable, such as, for example, high-purity $Al_2O_3$ ceramic as plate material. Water is best used as coolant in the cooling fins. In the additionally provided cavities another cooling liquid which is transparent to microwaves, such as, for example, the aforementioned fluorohydrocarbons FC 43 or FC 75, must be used.

Overall, the invention provides a coupling-out window which has been designed to withstand the highest radiative stresses and may both be produced by conventional means and also be operated economically.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a waveguide, a coupling-out window for linearly polarized high-power microwaves, having at least one plate which is situated in a plate plane and is transparent to microwaves, which coupling-out window exhibits cooling fins which are disposed in the plate plane perpendicular to the direction of polarization of the microwaves and are in heat-conducting and pressure-locking contact with the at least one plate, wherein the cooling fins are accommodated in groove-like recesses penetrating from a main surface into the plate.

2. The coupling-out window as claimed in claim 1, wherein the cooling fins are formed by the recesses sealed by metal coverings.

3. In a waveguide, a coupling-out window for linearly polarized high-power microwaves, having at least one plate which is situated in a plate plane and is transparent to microwaves, which coupling-out window exhibits cooling fins which are disposed in the plate plane perpendicular to the direction of polarization of the microwaves and are in heat-conducting and pressure-locking contact with the at least one plate, wherein a) the cooling fins are at least as thick as the plate, and wherein b) the plate is divided up by the cooling fins into individual, strip-like portions.

4. In a waveguide, a coupling-out window for linearly polarized high-power microwaves, having at least one plate which is situated in a plate plane and is transparent to microwaves, which coupling-out window exhibits cooling fins which are disposed in the plate plane perpendicular to the direction of polarization of the microwaves and are in heat-conducting and pressure-locking contact with the at least one plate, wherein the plate exhibits, between adjacent cooling fins, cavities through which a coolant flows.

5. The coupling-out window as claimed in claim 1, 3 or 4, wherein a) the cooling fins have a width which is smaller than or equal to an order of magnitude corresponding to a wavelength of the microwaves, and b) a mutual spacing which is greater than or equal to an order of magnitude corresponding to a wavelength of the microwaves, and wherein c) the cooling fins are channels through which coolant flows.

6. The coupling-out window as claimed in claim 1, 3 or 4, wherein the cooling fins are entirely embedded in the plate.

7. The coupling-out window as claimed in claim 1, 3 or 4 wherein a) the cooling fins are made at least partially of metal, wherein b) the plate is made of ceramic, and wherein c) the heat-conducting and pressure-locking contact is formed by a soldered joint.

8. The coupling-out window as claimed in claims 1, 3 or 4, wherein the cooling fins have a cross-section selected from the group consisting of rectangular, circular and elliptical cross-sections.

9. The coupling-out window as claimed in claims 1, 3 or 4, wherein a) the cooling fins are metal tubes soldered in the plate, b) and wherein the plate comprises a material selected from the group consisting of monocrystalline sapphire and a high-stress ceramic.

* * * * *